US009233379B2

(12) United States Patent
Zhou et al.

(10) Patent No.: US 9,233,379 B2
(45) Date of Patent: Jan. 12, 2016

(54) PAT-SWITCHING SPRINKLER

(75) Inventors: Huasong Zhou, Xiamen (CN); Hongliang Ma, Xiamen (CN); Jianmin Chen, Xiamen (CN); Liangwei Wang, Xiamen (CN)

(73) Assignees: XIAMEN SOLEX HIGH-TECH INDUSTRIES CO., LTD., Xiamen (CN); Huasong Zhou, Xiamen (CN)

( * ) Notice: Subject to any disclaimer, the term of this patent is extended or adjusted under 35 U.S.C. 154(b) by 267 days.

(21) Appl. No.: 13/977,570

(22) PCT Filed: Dec. 30, 2011

(86) PCT No.: PCT/CN2011/084973

§ 371 (c)(1),
(2), (4) Date: Jun. 28, 2013

(87) PCT Pub. No.: WO2012/089150

PCT Pub. Date: Jul. 5, 2012

(65) Prior Publication Data

US 2013/0284823 A1 Oct. 31, 2013

(30) Foreign Application Priority Data

Dec. 30, 2010 (CN) ..... 2010 1 0618442

(51) Int. Cl.
*B05B 1/16* (2006.01)
*B05B 1/18* (2006.01)

(52) U.S. Cl.
CPC ..... *B05B 1/169* (2013.01); *B05B 1/1636* (2013.01); *B05B 1/18* (2013.01)

(58) Field of Classification Search
CPC ..... B05B 1/16; B05B 1/1636; B05B 1/169; B05B 1/18; B05B 1/185; B05B 12/002; E03C 1/0405
See application file for complete search history.

(56) References Cited

U.S. PATENT DOCUMENTS

| | | | | |
|---|---|---|---|---|
| 4,398,669 | A * | 8/1983 | Fienhold | 239/447 |
| 5,433,384 | A * | 7/1995 | Chan et al. | 239/449 |
| 5,476,225 | A * | 12/1995 | Chan | 239/449 |
| 6,412,711 | B1 * | 7/2002 | Fan | 239/446 |
| 6,622,945 | B1 * | 9/2003 | Wu et al. | 239/443 |
| 7,434,751 | B1 | 10/2008 | Chen | |

(Continued)

FOREIGN PATENT DOCUMENTS

| | | | |
|---|---|---|---|
| CN | 101069877 | A | 11/2007 |
| CN | 101832407 | A | 9/2010 |

(Continued)

*Primary Examiner* — Ryan Reis
(74) *Attorney, Agent, or Firm* — Rabin & Berdo, P.C.

(57) ABSTRACT

The present invention is provided with a pat-switching sprinkler, which is provided with a fixation unit (100), an operation bat (200) and switching mechanism (300). The fixation unit (100) is provided with a water entry (110) and multiple water exits (120) which can get through with the water entry (110). The operation bat is provided with an operation part (210), a connection part (220) and a pin-jointed part (230), which pivots the fixation unit. The connection part (220) and the operation part (210) respectively lie at the inner side and external side of the fixation unit. The switching mechanism (300) is arranged in the fixation unit (100) and is in transmission with the connection part (220). It has advantages as below: swing the operation bat by patting it, which can put the switching mechanism in motion to switch the water exits. Thus, it saves the switching force and can be switched reliably and conveniently.

9 Claims, 12 Drawing Sheets

(56) References Cited

U.S. PATENT DOCUMENTS

2008/0017735 A1* 1/2008 Zhou ..... 239/437
2009/0288250 A1* 11/2009 Zhou ..... 4/615

FOREIGN PATENT DOCUMENTS

CN 102101077 A 6/2011
EP 1262240 A1 12/2002

* cited by examiner

PAT-SWITCHING SPRINKLER

FIELD OF THE INVENTION

The present invention relates to a pat-switching sprinkler.

BACKGROUND OF THE INVENTION

The present sprinkler comprises a fixation unit and a switching mechanism arranged in the fixation unit. The fixation unit is provided with a water entry and multiple water exits. The water exits' switching can be realized by the switching mechanism. The switching mechanism mainly falls into a sliding switch or a rotation switch. No matter whether you have a sliding switch or a rotation switch, an operation component should be arranged on the fixation unit to control the mechanism. Presently, the operation component is mostly connected to the fixation unit by a rotating or sliding connection. So it has disadvantages as discussed below: operating forcedly and inconveniently.

SUMMARY OF THE INVENTION

The present invention is provided with a pat-switching sprinkler, which overcomes the disadvantages of the existing technology. The technical proposal of the present invention to solve the technical problem is as below:

A pat-switching sprinkler comprises a fixation unit (100), which is provided with a water entry (110) and multiple water exits (120) which can get through with the water entry (110);

An operation bat (200), which is provided with an operation part (210), a connection part (220), a pin-jointed part (230) that is arranged between the operation part (210) and connection part (220); the pin-jointed part (230) pivots the fixation unit (100), the connection part (220) and the operation part (210) respectively lie at the inner side and external side of the fixation unit (100);

A switching mechanism (300) is arranged in the fixation unit (100) and is in transmission with the connection part (220).

Wherein, the operation part (210) swings by patting, which can put the switching mechanism (200) in motion to switch the water exits (120). The operation bat (200) can be reset.

In a preferred embodiment, the fixation unit (100) further includes a water-out terminal (150), where the multiple water exits (120) are arranged, and the water exits' ports are circlewise displayed on the switching surface (151) of the water-out terminal (150);

An upper cover (160) is fixedly connected to the water-out terminal (150) hermetically and covers the water exits' (120) ports, a switching chamber (140) being formed between the upper cover (160) and the water-out terminal (150);

A shell (170) is fixedly connected to the water-out terminal (150) and covers the upper cover (160);

A water conduit (180) is fixedly connected to the shell (170) in the upper end and passes through the external water supply, furthermore, it is fixedly connected to the upper cover (160) in the lower end and passes through the switching chamber (140).

In a preferred embodiment, the operation bat's (200) pin jointed part (230) pivots the shell (170) and the connection part (220) and the operation part (210) respectively lie at the inner side and external side of the shell (170), the switching mechanism (300) is connected to the upper cover (160).

In a preferred embodiment, the fixation unit (100) is provided with a first gear (130);

The switching mechanism (300) comprises a central shaft (310), which is slidably connected to the fixation unit (100) and a second gear (311) is arranged on it;

A switching panel (320), whose center part arranges a third gear (321), which rotates and slides with the fixation unit (100), where the water exits (120) can be switched by rotation;

A resetting spring (330), which presses against the switching panel (320);

Wherein, the third gear (321) can match up with the first gear (130) and the second gear (311), so that the operation part (210) swings by patting, the central shaft (310) raises up, then the resetting spring (330) stores energy, the second gear (311) and the third gear (321) match up to make the switching panel (320) raise up and rotate forward, the resetting spring (330) releases the energy, then the switching panel (320) moves down, the first gear (130) and the third gear (321) match up to make the switching panel (320) rotate forward, then the central shaft (310) and the operation bat (200) reset.

In a preferred embodiment, a sliding chute (221) is arranged on the connection part (220), a toroidal chute (312) is arranged on the upper end of the central shaft (310);

The switching mechanism (300) further comprises a lever (340), the central part of the lever (340) pivots to the fixation unit (100), the first end of the lever (340) is adaptively connected to the sliding chute (211) by a pin (341), a prong (342) is arranged on the second end of the lever (340), which plugs the toroidal chute (312), to make the operation bat's (210) swinging and the central shaft's (310) sliding form a linkage.

In a preferred embodiment, the first gear (130) is arranged on the switching surface (151), the second gear (311) is arranged on the lower end of the central shaft (310), the switching panel (320) is arranged in the switching chamber (140);

The central shaft (310) is slidably connected to the upper cover (160) hermetically and the lower end is in the switching chamber (140), the upper end stretches out on the upper cover (160);

The central part of the lever (340) pivots on the upper cover (160);

The resetting spring (330) is muff-connected to the central shaft (310) and presses between the switching panel (320) and the upper cover (160).

In a preferred embodiment, the switching mechanism (300) comprises a switching panel (320), which can rotate with the fixation unit (100) and realize the switching of the water exits (120) by rotation;

A ratchet (350), which can rotate with the fixation unit (100) and form the synchronous and coaxial rotation relationship with the switching panel (320);

A pawl (360), which is provided with a pin socket, stirring jaw (361) and a pressing jaw (362), the pin socket pivots to the fixation unit (100);

A resetting spring, which is connected to the pawl (360) and fixation unit (100).

Wherein, the stirring jaw (361) and the pressing jaw (362) are all matched up with the ratchet (350), so that the operation part (210) swings by patting, the pawl (360) rotates forward, the stirring jaw (361) presses against the ratchet (350) to make it rotate forward and the resetting spring stores energy; When rotating to the place, the pressing jaw (362) presses against the ratchet (350) to position the ratchet (350), the resetting spring releases energy to make the pawl (360) reverse and reset, and the operation bat (200) resets.

Compared to the existing technology, the technical proposal of the present invention has advantages as below:

1. Swinging the operation bat by patting it, it can put the switching mechanism in motion to switch the water exits, thus, it saves switching force and can be switched reliably and conveniently.

2. The fixation unit comprises water-out terminal, upper cover, shell and water conduit; the water exits' ports are circlewise displayed on the switching surface, the upper cover and the water-out terminal form the switching chamber, which is convenient to design and is connected to the switching mechanism, it is laid out reasonably and takes less room.

3. The water conduit is fixedly connected to the shell in the upper end and passes through the external water supply, and that is fixedly connected to the upper cover in the lower end and get through the switching chamber; thus, it is convenient to design the seal structure and layout reasonably.

4. The switching mechanism comprises central shaft, switching panel and resetting spring, it matches up with the first gear to form a structure that is similar to an automatic ball pen; the switching mechanism takes less room, the switching panel switches separately from the switching surface, it needs less force.

5. The operation bat impels the central shaft to slide by the lever, needs less force and easily switches at high pressure.

6. The switching mechanism comprises switching panel, pawl and ratchet; realizes circulatory witching and needs less room.

7. The switching mechanism comprises a swing pipe, the swing pipe's swinging impels the ball sealer to move, and then realize the switching of the water exits; the swing pipe can be reversely reset under the influence of the gravity. It needs less room.

BRIEF DESCRIPTION OF THE DRAWINGS

The present invention will be further described with drawings and embodiments.

DETAILED DESCRIPTION OF THE EMBODIMENT

Figure 1:
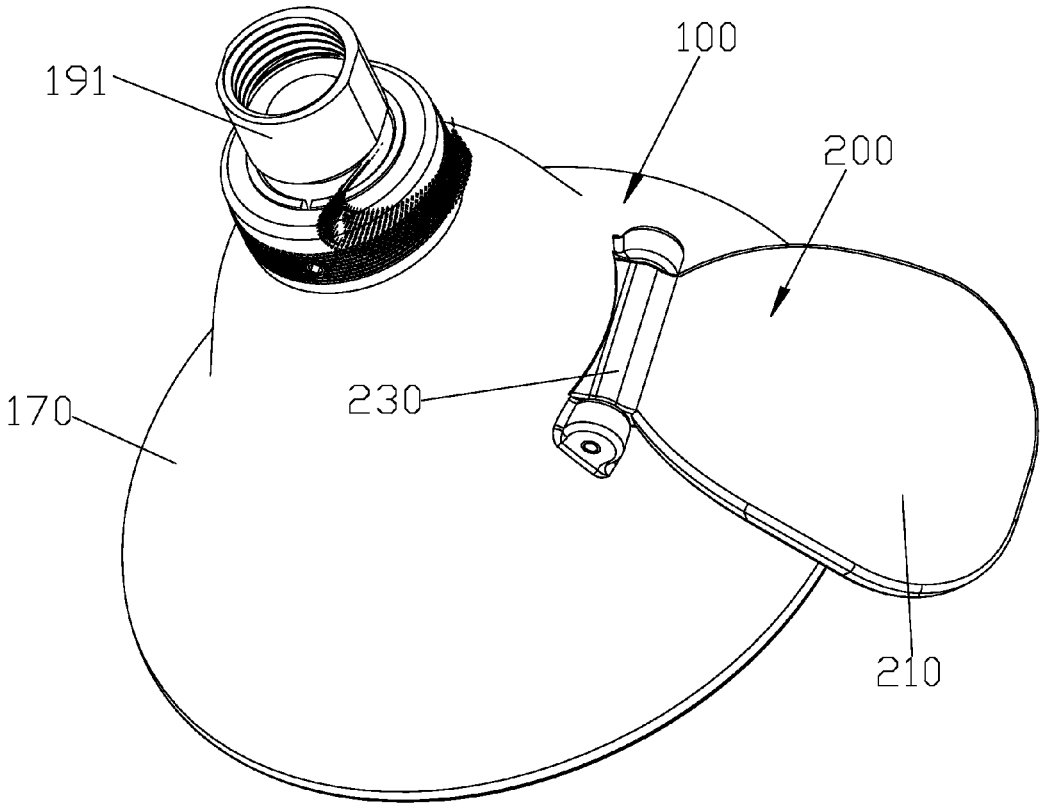
FIG. 1 illustrates the solid structure of a pat-switching sprinkler of the preferred embodiment 1 of the present invention.
Figure 2:
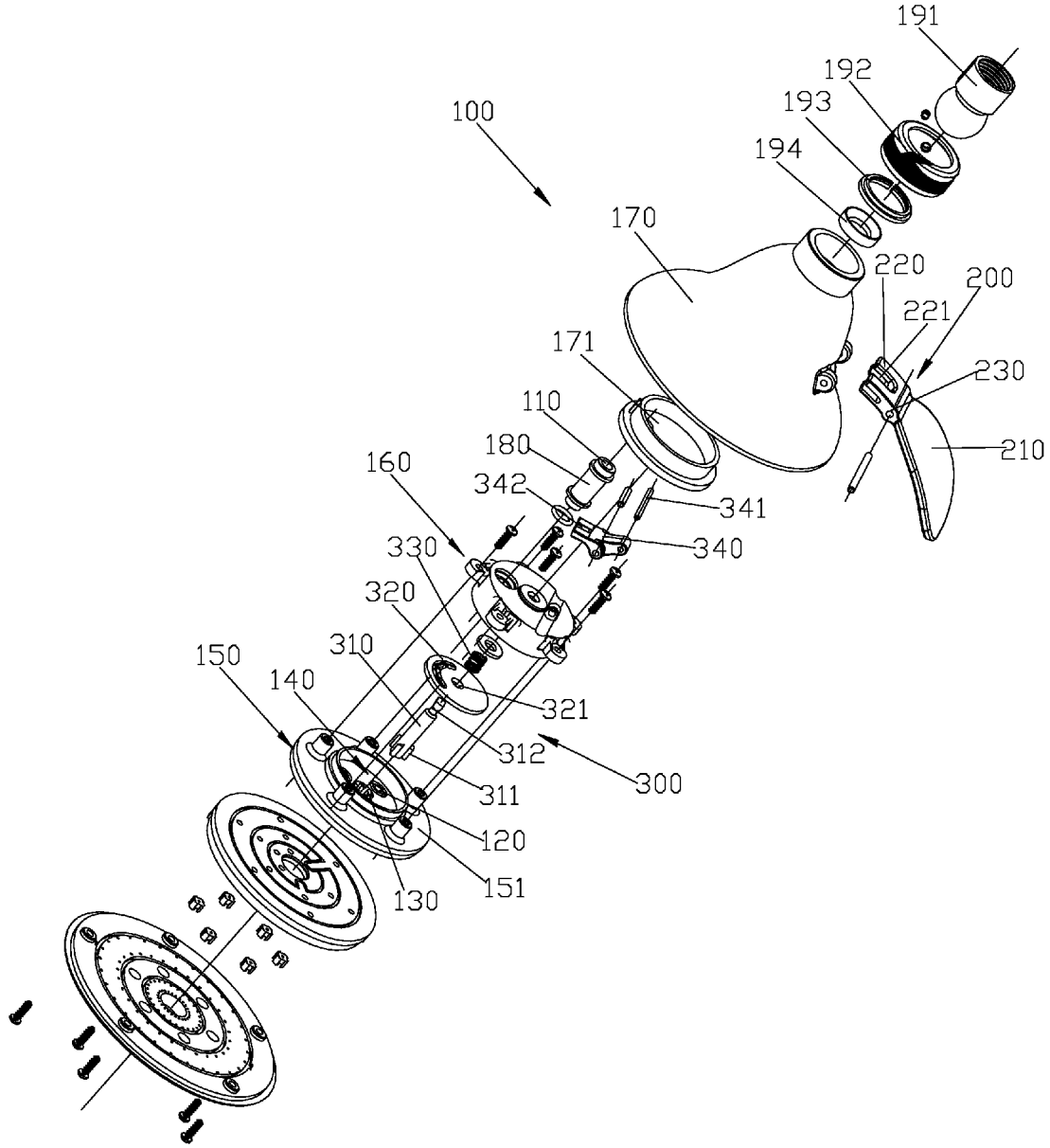
FIG. 2 illustrates the solid breakdown structure 1 of a pat-switching sprinkler of the preferred embodiment 1 of the present invention.
Figure 3:
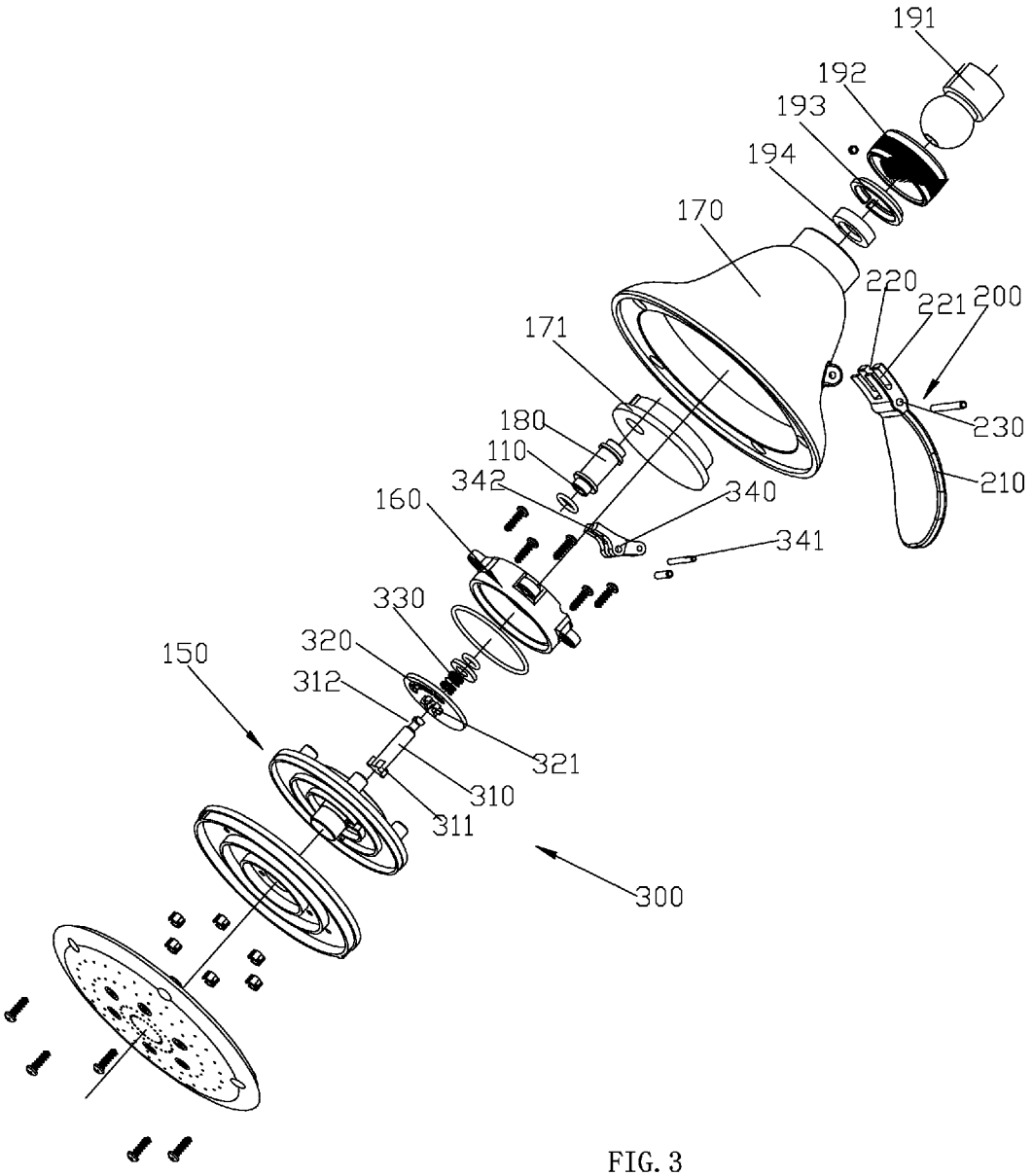
FIG. 3 illustrates the solid breakdown structure 2 of a pat-switching sprinkler of the preferred embodiment 1 of the present invention.
Figure 4:
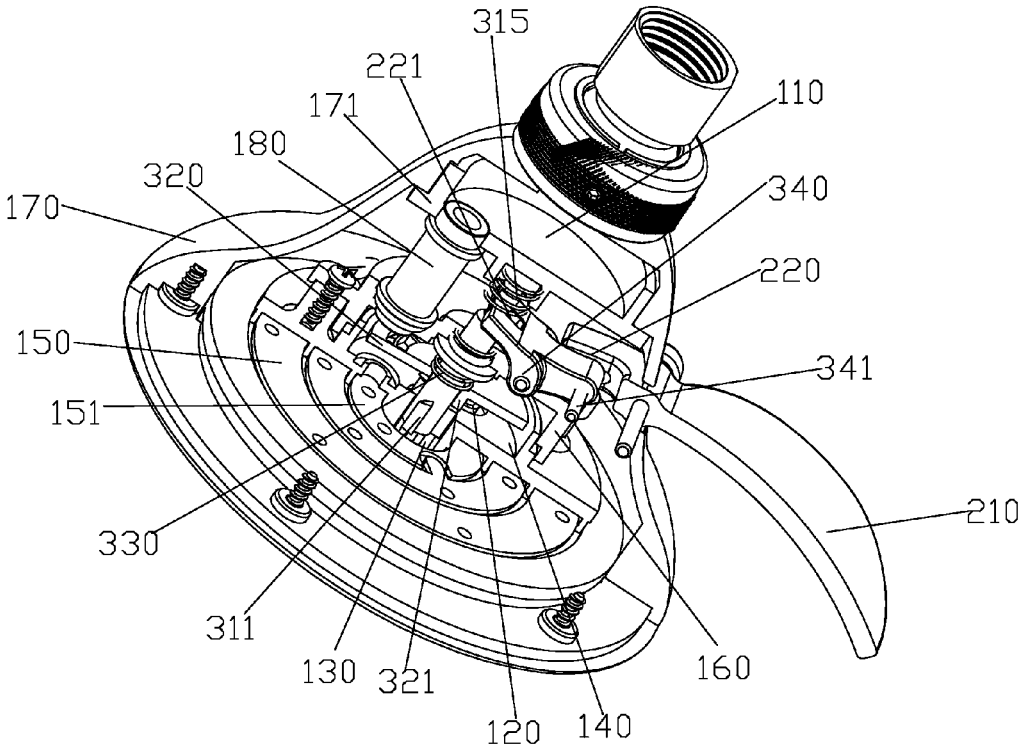
FIG. 4 illustrates the solid part sectional view 1 of a pat-switching sprinkler of the preferred embodiment 1 of the present invention.
Figure 5:
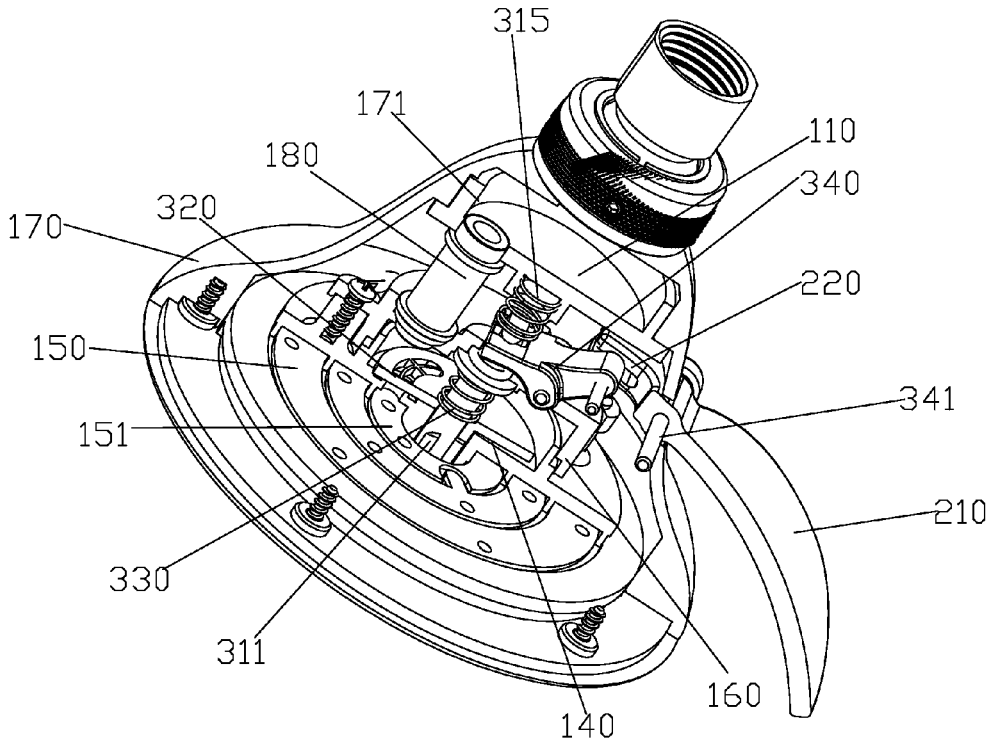
FIG. 5 illustrates the solid part sectional view 2 of a pat-switching sprinkler of the preferred embodiment 1 of the present invention.
Figure 6:
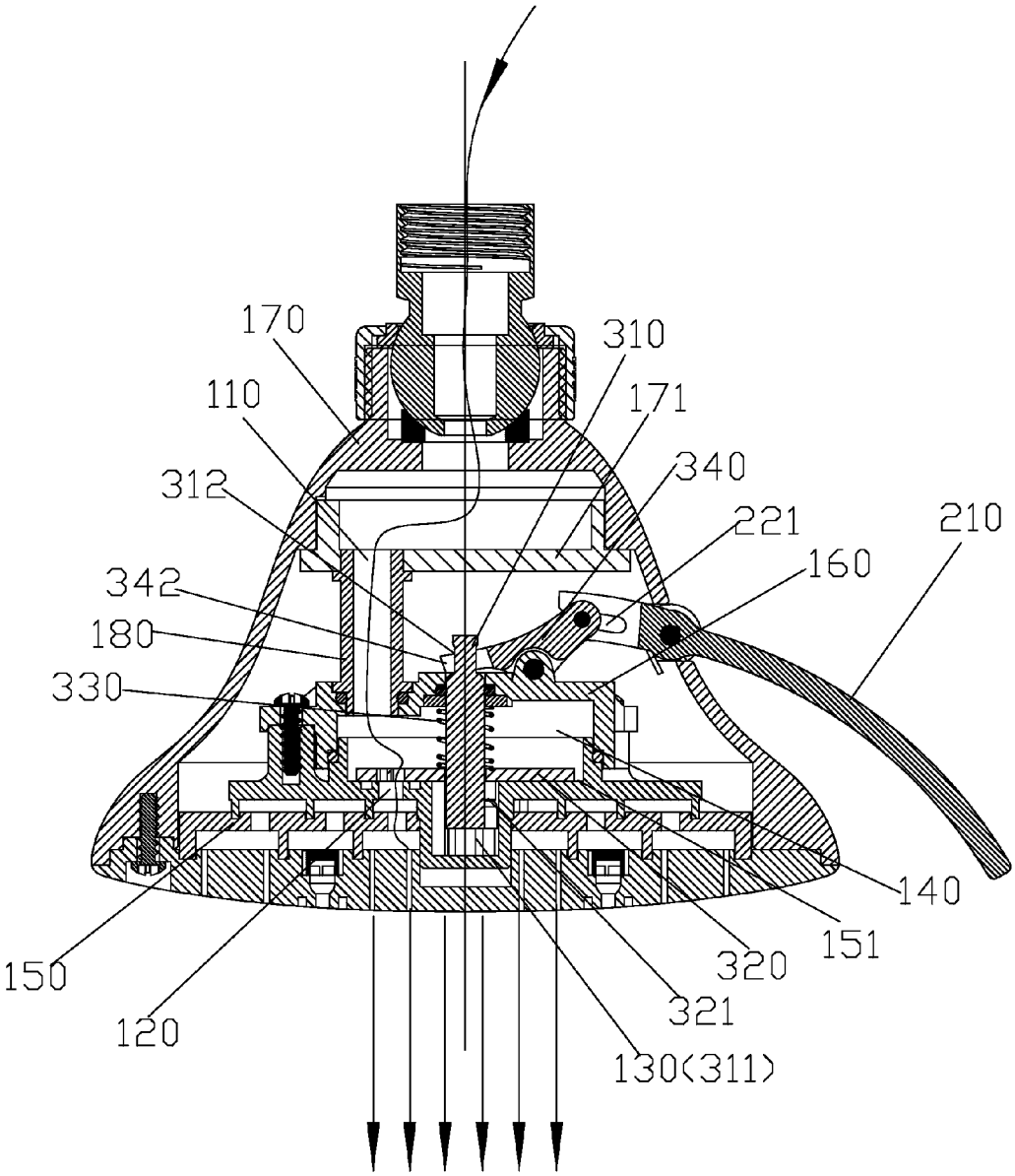
FIG. 6 illustrates the sectional view of a pat-switching sprinkler of the preferred embodiment 1 of the present invention. The water flows out from the first water exit at this moment.
Figure 7:
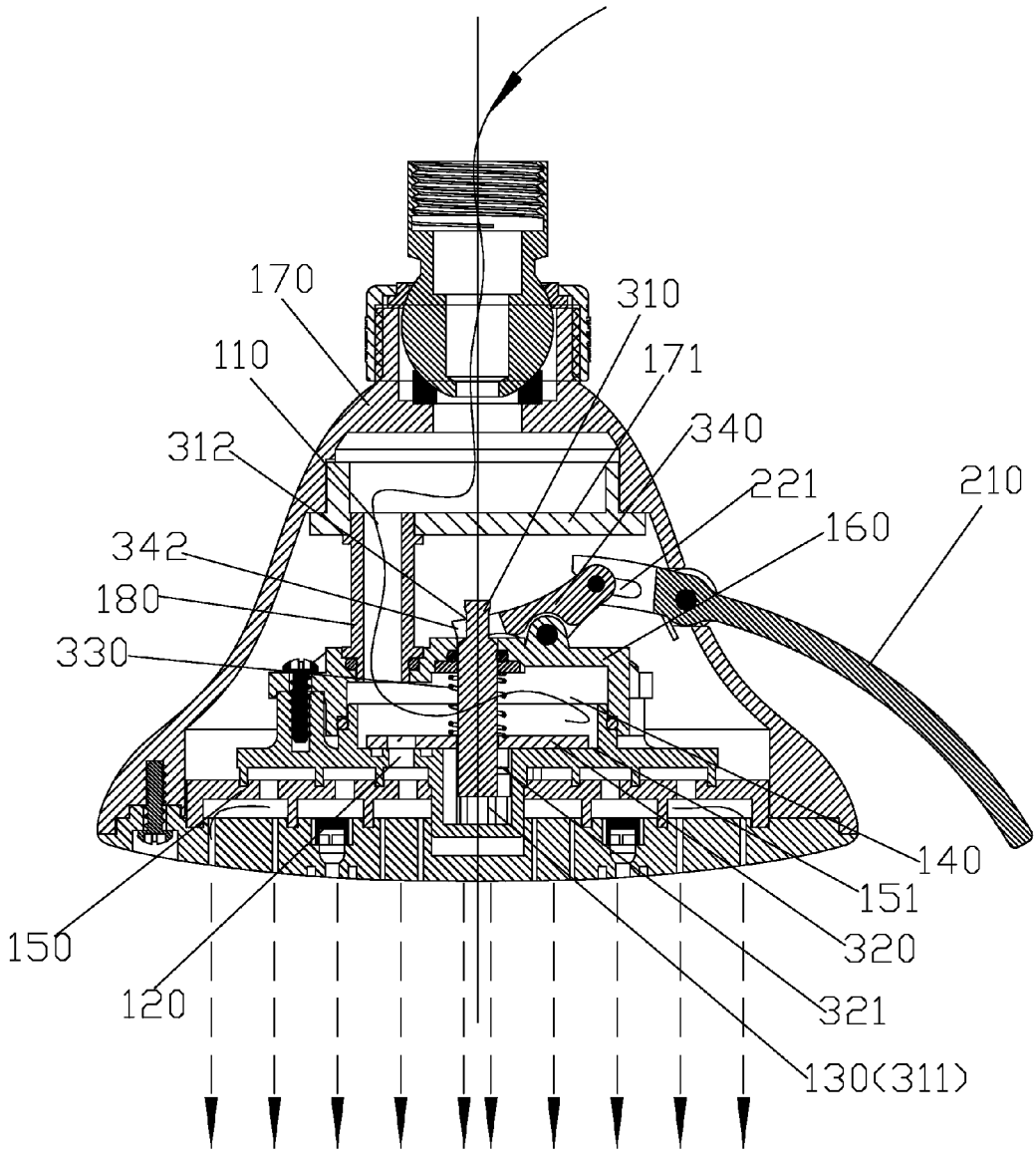
FIG. 7 illustrates the sectional view of a pat-switching sprinkler of the preferred embodiment 1 of the present invention. The water flows out from the second water exit at this moment.
Figure 8:
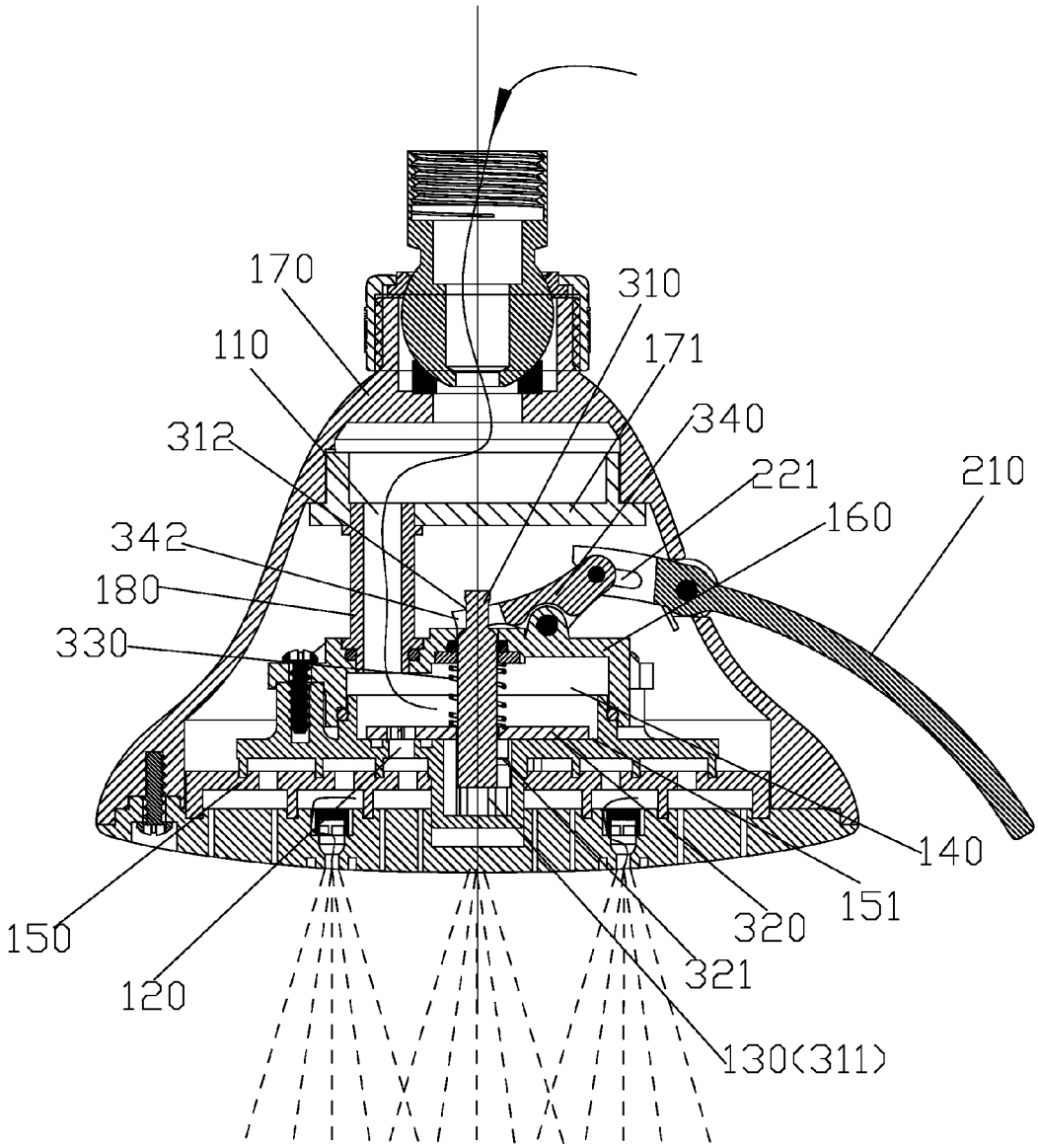
FIG. 8 illustrates the sectional view of a pat-switching sprinkler of the preferred embodiment 1 of the present invention. The water flows out from the third water exit at this moment.

Please refer to FIG. 1 to FIG. 8 in the preferred embodiment 1. A pat-switching sprinkler is provided with a fixation unit 100, an operation bat 200 and a switching mechanism 300.

The fixation unit 100 comprises a water-out terminal 150, an upper cover 160, a shell 170 and a water conduit 180.

The water-out terminal has three functions, every function corresponds to one water exit 120; the water exits' ports are circlewise displayed on the switching surface 151 of the water-out terminal 150.

The upper cover 160 is provided with an enclosure bulkhead and a cover plate that is fixedly connected the enclosure bulkhead; the enclosure bulkhead is tightly connected to the switching surface 151 of the water-out terminal 150; in order to make sure the sealing property, it's better to arrange a sealed circular bulkhead; the sealed circular bulkhead and the enclosure bulkhead are tightly connected, then the upper cover 160 and the water-out terminal 150 are locked by the screws, so that the water exits 120 can be covered in the upper cover 160, the switching chamber 140 is formed between the upper cover 160 and the water-out terminal 150, the switching chamber can get through the water exits 120.

The shell 170 comprises a horn shell and a sealed board 171; the sealed board is fixedly connected to the horn shell and constitutes a water-out chamber with the horn shell, the shell 170 can be fixedly connected to the water pipe of the water supply and the water can be introduced into the water-out chamber by bulb 191, outer ring 192, stop collar 193 and rubber blanket 194; in this embodiment, the shell 170 is fixedly connected to the water-out terminal 150, and the upper cover 160 is covered in it.

The water conduit 180, which is fixedly connected to the shell 170 in the upper end and can get through the external water supply, furthermore, and that is fixedly connected to the upper cover 160 in the lower end and gets through the switching chamber 140; in this embodiment, the water-out chamber and the water conduit constitute the water entry 110.

The operation bat 200 is provided with an operation part 210, a connection part 220, a pin-jointed part 230 that pivots the shell 170 of the fixation unit 100; the connection part 220 and the operation part 210 respectively lie at the inner side and external side of the shell 170, a sliding chute 221 is arranged on the connection part 220.

A switching mechanism 300 is arranged in the fixation unit 100 and is in transmission with the connection part 220 in this embodiment, In the center of the switching surface 151 of the water-out terminal 150 on the fixation unit 100, a first gear 130 is arranged.

The switching mechanism 300 comprises a central shaft 310, a switching panel 320, a resetting spring 330, a lever 340 and a compression spring 315; the central shaft 310 is slidably connected to the upper cover 160 hermetically and the lower end is in the switching chamber 140, the upper end stretches out on the upper cover 160, and the second gear 311 is arranged on the lower end, a toroidal chute 312 is arranged on the upper end of the central shaft 310, a third gear 321 is arranged on the switching panel's 320 center part, which is movably muff-connected to the center shaft 310, so that it can rotate and slide up and down with the fixation unit 100 and the water exits 120 can be switched by rotating it, the resetting spring 330 is muff-connected to the central shaft 310 and presses between the switching panel 320 and the upper cover 160, the central part of the lever 340 pivots over the upper cover 160 of the fixation unit 100, the first end of the lever 340 is adaptively connected to the sliding chute 211 by a pin 341, a prong 342 is arranged on the second end of the lever 340, which plugs the toroidal chute 312, to make the operation bat's 210 swinging and the central shaft's 310 sliding form a linkage, the compression spring 315 is arranged between the connection part and the sealed board to reset the central shaft and the operation bat.

Wherein, the third gear 321 can match up with the first gear 130 and the second gear 311, so that the operation part 210 swings by patting, the central shaft 310 raises up, then the resetting spring 330 stores energy, the second gear 311 and the third gear 321 match up to make the switching panel 320 raise up and rotate forward, the resetting spring 330 releases the energy, and the switching panel 320 moves down, the first gear 130 and the third gear 321 match up to make the switching panel 320 rotate forward, the central shaft 310 and the operation bat 200 reset.

In this embodiment, a through-hole is arranged on the switching panel, with rotation, the through-hole aligns a certain water exit, then the water flows out and realizes water exit's switching.

Figure 9:
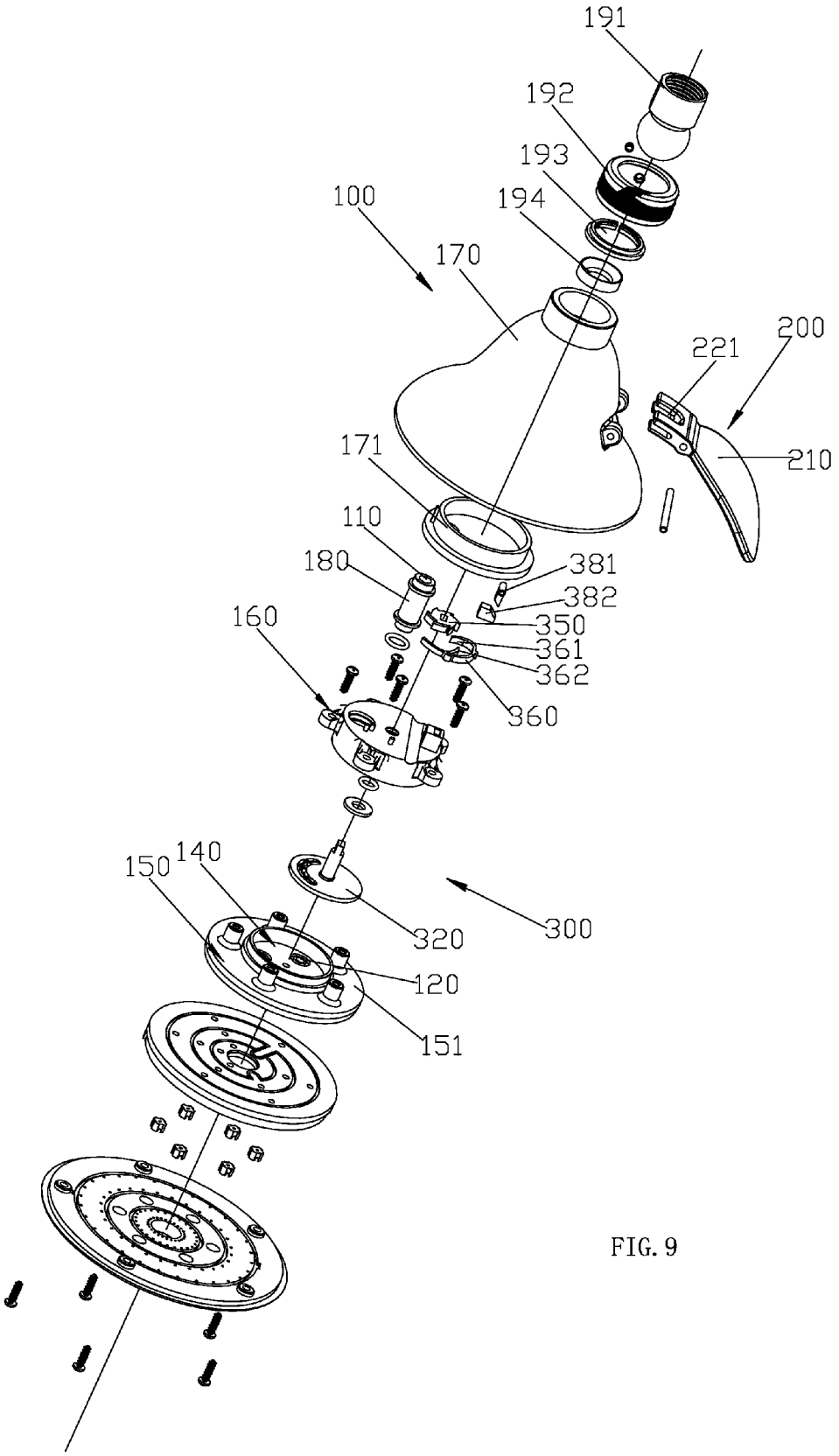
FIG. 9 illustrates the solid breakdown structure 1 of a pat-switching sprinkler of the preferred embodiment 2 of the present invention.
Figure 10:
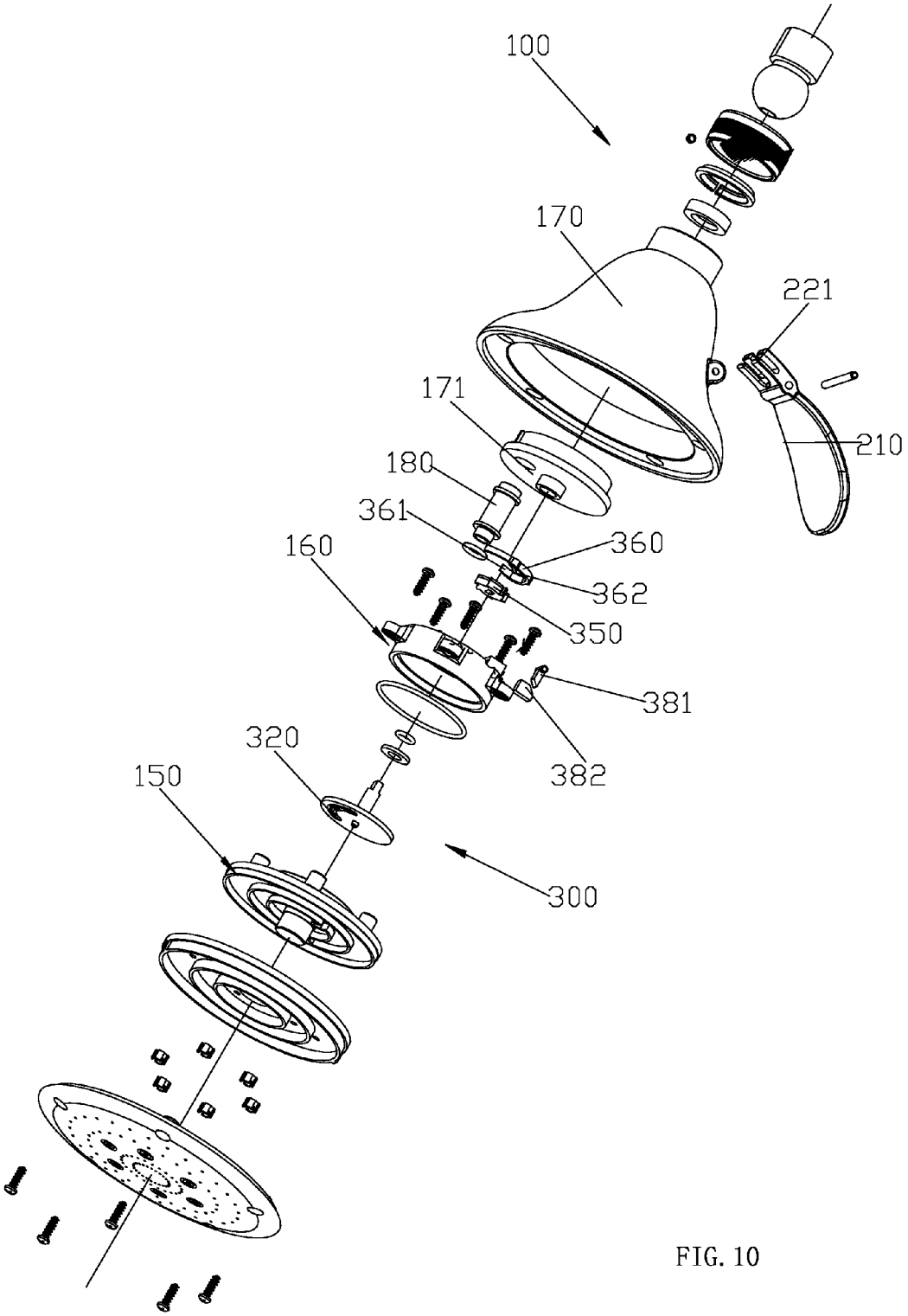
FIG. 10 illustrates the solid breakdown structure 2 of a pat-switching sprinkler of the preferred embodiment 2 of the present invention.
Figure 11:
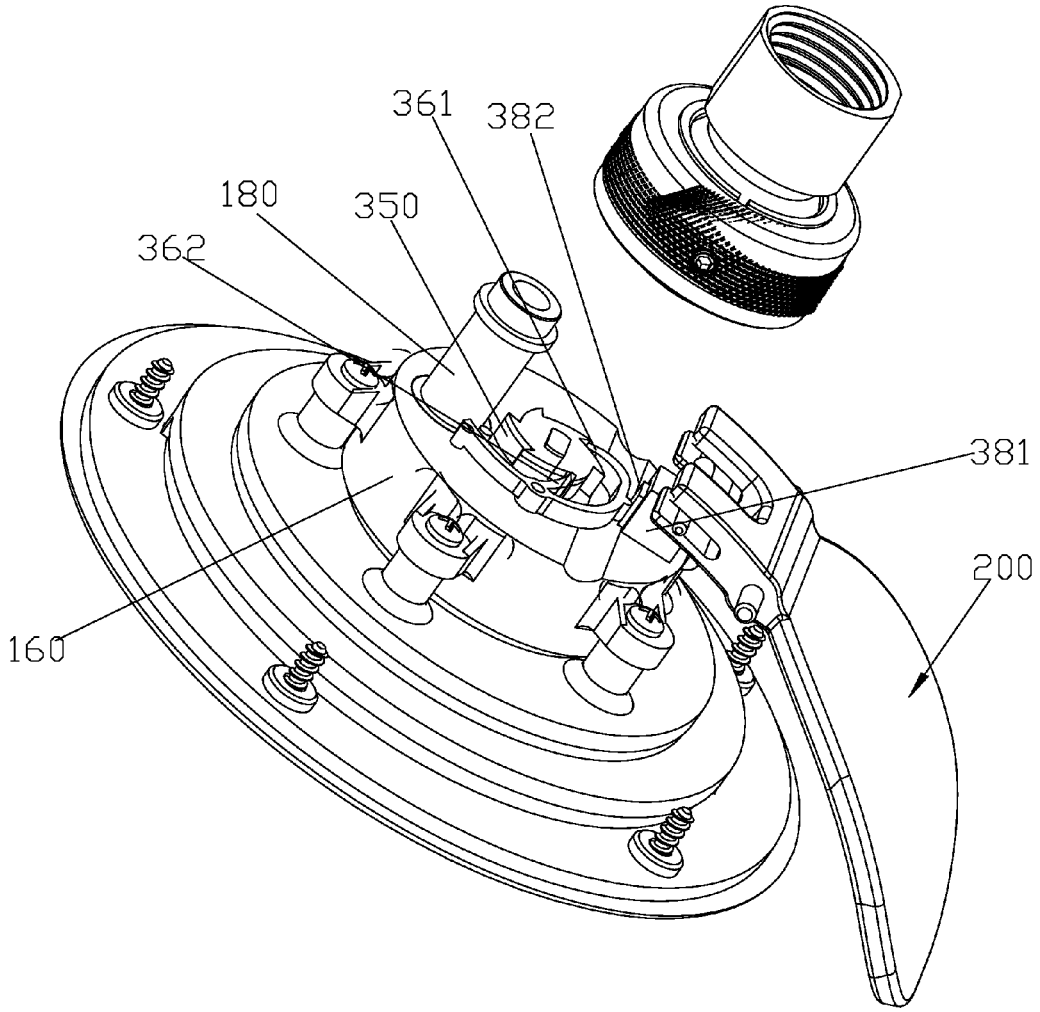
FIG. 11 illustrates the solid part sectional view 1 of a pat-switching sprinkler of the preferred embodiment 2 of the present invention.
Figure 12:
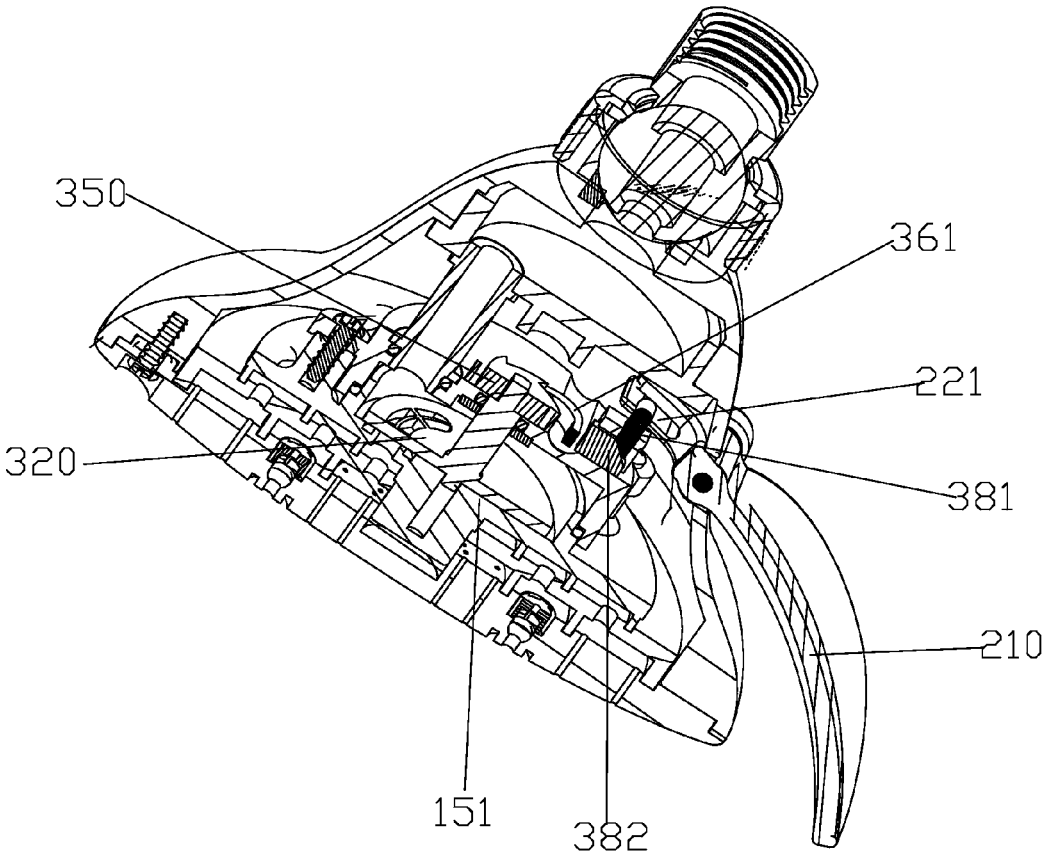
FIG. 12 illustrates the solid part sectional view 2 of a pat-switching sprinkler of the preferred embodiment 2 of the present invention.
Figure 13:
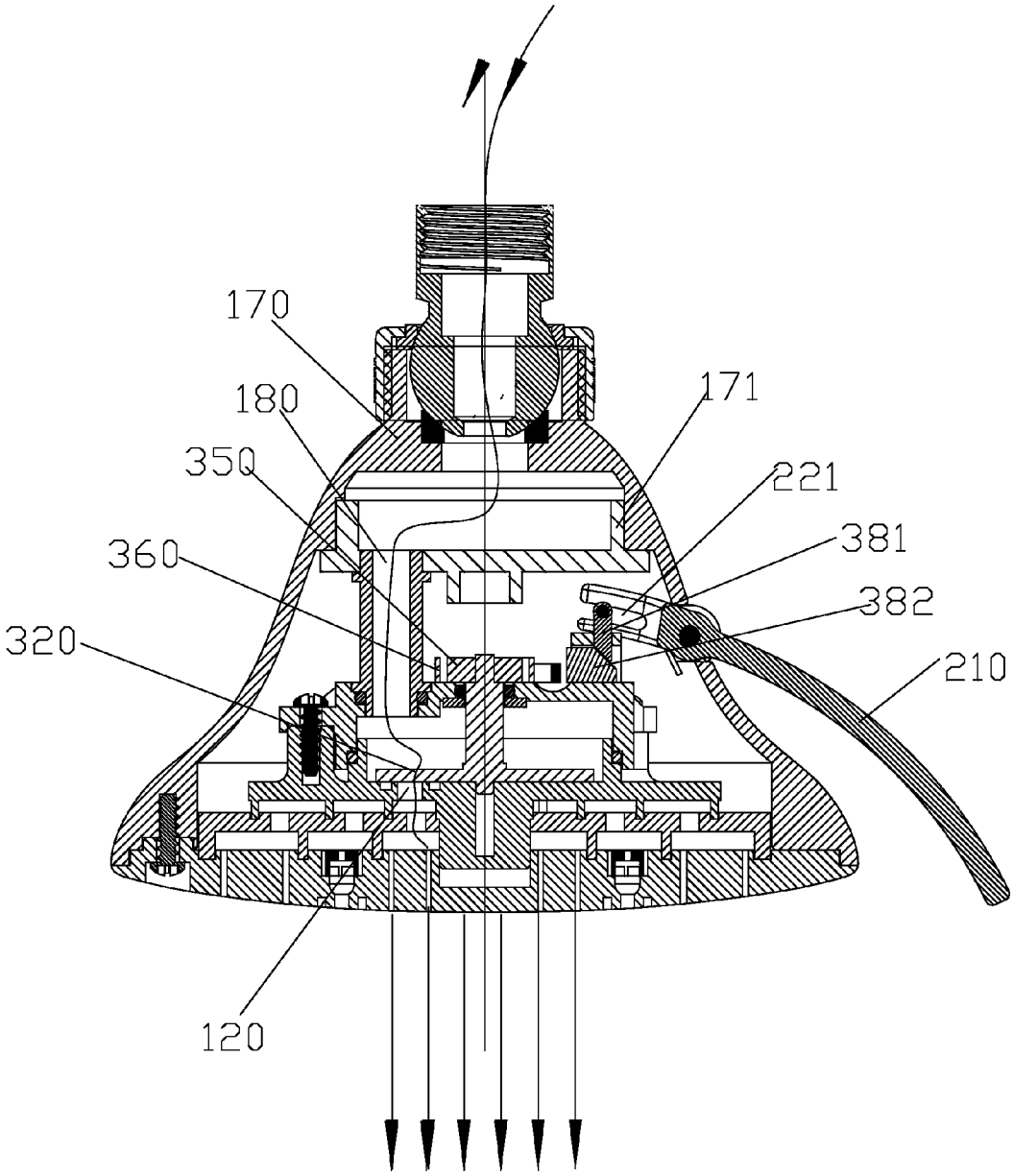
FIG. 13 illustrates the sectional view of a pat-switching sprinkler of the preferred embodiment 2 of the present invention.

In the embodiment 2, it has difference from the embodiment 1 as bellow: please refer to FIG. 9 to FIG. 13. The switching mechanism 300 comprises a switching panel 320, a ratchet 350, a pawl 360 and a resetting spring; the switching panel is arranged in the switching chamber 140 and is tightly connected to the switching surface, the switching panel 320 can rotate with the fixation unit 100 to realize the water exit's 120 switching, the ratchet 350 can be arranged over the upper cover 160, the ratchet 350 forms a synchronous and coaxial rotation relationship with the switching panel 320, the pawl 360 is provided with a pin socket, stirring jaw 361 and a pressing jaw 362, the pin socket pivots to the fixation unit 100; wherein, the stirring jaw 361 and the pressing jaw 362 are all matched up with the ratchet 350, so that the operation part 210 swings by patting, the pawl 360 rotates forward, the stirring jaw 361 presses against the ratchet 350 to make it rotate forward and the resetting spring stores energy; when rotating to the place, the pressing jaw 362 presses against the ratchet 350 to position the ratchet 350, the resetting spring releases energy to make the pawl 360 reverse and reset, and the operation bat 200 resets.

As required, the following structure can be set between the pawl 360 and operation bat 200: a clinohedral 381 and a slider 382 can be added in the fixation unit 100; when the operation bat swings, the connection part impels the clinohedral 381 to slide, then the clinohedral 381 impels the slider 382 to slide left and drives the pawl rotating forward.

Of course, the invention is not limited to the examples which have just been described and many adjustments may be made to these examples without departing from the scope of the invention, notably as regards the number, the type and the position of the connectors, the way of laying out the interface with the user. The standards and norms which are cited in this document as an example are by no means limiting, their equivalents as well as their successors enter the scope of the invention.

INDUSTRIAL APPLICABILITY

The present invention is provided with a pat-switching sprinkler, an operation bat is arranged. Swinging the operation bat by patting it, which can put the switching mechanism in motion to switch the water exits. Thus, it saves the switching force and can be switched reliably and conveniently.

What is claimed is:

1. A pat-switching sprinkler, comprising a fixation unit, which is provided with a water entry and multiple water exits which can be connected to the water entry;

an operation bat, which is provided with an operation part, a connection part, a pin-jointed part that is arranged between the operation part and connection part;

the pin-jointed part pivots the fixation unit, the connection part and the operation part respectively lie at an inner side and an external side of the fixation unit;

a switching mechanism, is arranged in the fixation unit and in transmission with the connection part;

the fixation unit is provided with a first gear, the switching mechanism comprises a central shaft, slidably connected to the fixation unit, and a second gear arranged on the central shaft;

a switching panel, a third gear being arranged on a center part of the switching panel, configured to rotate and slide with the fixation unit, so that the water exits are switched by rotation of the third gear;

a resetting spring, which presses against the switching panel;

wherein, the third gear is configured to match up with the first gear and the second gear, so that the operation part swings by patting, the central shaft raises up, then the resetting spring stores energy, the second gear and the third gear match up to make the switching panel raise up and rotate forward, the resetting spring releases the energy, then, the switching panel moves down, the first gear and the third gear match up to make the switching panel rotate forward to switch the water exits, and the central shaft and the operation bat reset.

2. A pat-switching sprinkler according to claim 1, wherein the fixation unit further comprising a water-out terminal, where the multiple water exits are arranged, and the water exits' ports are circlewise displayed on the switching surface of the water-out terminal;

an upper cover, which is fixedly connected to the water-out terminal hermetically and covers the water exits' ports in it;

the switching chamber is formed between the upper cover and the water-out terminal;

a shell, which is fixedly connected to the water-out terminal and the upper cover is covered in it;

a water conduit, which is fixedly connected to the shell in the upper end and can be connected to the external water supply, and that is fixedly connected to the upper cover in the lower end and can be connected to the switching chamber.

3. A pat-switching sprinkler according to claim 2, wherein the operation bat's pin-jointed part pivots the shell, and the connection part and the operation part respectively lie at the inner side and external side of the shell, the switching mechanism is connected to the upper cover.

4. A pat-switching sprinkler according to claim 1, wherein a sliding chute is arranged on the connection part;

a toroidal chute is arranged on the upper end of the central shaft;

the switching mechanism further comprises a lever, the central part of the lever pivots to the fixation unit;

the first end of the lever is adaptively connected to the sliding chute by a pin, a prong is arranged on the second end of the lever, which plugs the toroidal chute, to make the operation bat's swinging and the central shaft's sliding form a linkage.

5. A pat-switching sprinkler according to claim 4, wherein the first gear is arranged on the switching surface, the second gear is arranged on the lower end of the central shaft, the switching panel is arranged in the switching chamber;

the central shaft is slidably connected to the upper cover hermetically and the lower end is in the switching chamber, the upper end stretches out on the upper cover;

the central part of the lever pivots on the upper cover;

the resetting spring is muff-connected to the central shaft and presses between the switching panel and the upper cover.

6. A pat-switching sprinkler according to claim 4, further comprising:

a ratchet, which can rotate with the fixation unit and form the synchronous and coaxial rotation relationship with the switching panel;

a pawl, which is provided with a pin socket, stirring jaw and a pressing jaw, the pin socket pivots to the fixation unit;

the resetting spring is connected to the pawl and fixation unit;

wherein, the stirring jaw and the pressing jaw all match up with the ratchet, so that the operation part swings by patting, the pawl rotates forward, the stirring jaw presses against the ratchet to make it rotate forward and the resetting spring stores energy;

when rotating into place, the pressing jaw presses against the ratchet to position the ratchet, the resetting spring releases energy to make the pawl reverse and reset, and the operation bat resets.

7. A pat-switching sprinkler according to claim 3, wherein a sliding chute is arranged on the connection part;

a toroidal chute is arranged on the upper end of the central shaft;

the switching mechanism further comprises a lever, the central part of the lever pivots to the fixation unit;

the first end of the lever is adaptively connected to the sliding chute by a pin, a prong is arranged on the second end of the lever, which plugs the toroidal chute, to make the operation bat's swinging and the central shaft's sliding form a linkage.

8. A pat-switching sprinkler according to claim 7, wherein the first gear is arranged on a switching surface, the second gear is arranged on the lower end of the central shaft, the switching panel is arranged in the switching chamber;

the central shaft is slidably connected to the upper cover hermetically and the lower end is in the switching chamber, the upper end stretches out on the upper cover;

the central part of the lever pivots on the upper cover;

the resetting spring is muff-connected to the central shaft and presses between the switching panel and the upper cover.

9. A pat-switching sprinkler according to claim 7, further comprising:

a ratchet, which can rotate with the fixation unit and form the synchronous and coaxial rotation relationship with the switching panel;

a pawl, which is provided with a pin socket, stirring jaw and a pressing jaw, the pin socket pivots to the fixation unit;

a resetting spring is connected to the pawl and fixation unit;

wherein, the stirring jaw and the pressing jaw all match up with the ratchet, so that the operation part swings by patting, the pawl rotates forward, the stirring jaw presses against the ratchet to make it rotate forward and the resetting spring stores energy;

when rotating into place, the pressing jaw presses against the ratchet to position the ratchet, the resetting spring releases energy to make the pawl reverse and reset, and the operation bat resets.

* * * * *